US006935802B1

(12) United States Patent
Byun

(10) Patent No.: US 6,935,802 B1
(45) Date of Patent: Aug. 30, 2005

(54) COSMETICS BRUSH

(76) Inventor: Young-Chul Byun, 206-1702, UjangsanLotteNakchundaeAPT. 1145, Hwagok-ding, Gangseo-Gu, Seoul 157-010 (KR)

( * ) Notice: Subject to any disclaimer, the term of this patent is extended or adjusted under 35 U.S.C. 154(b) by 0 days.

(21) Appl. No.: 10/795,293

(22) Filed: Mar. 9, 2004

(30) Foreign Application Priority Data

Feb. 19, 2004 (KR) ..... 10-2004-0011020

(51) Int. Cl.[7] ..... A46B 11/04
(52) U.S. Cl. ..... 401/278; 401/187; 401/188 R; 401/269
(58) Field of Search ..... 401/187, 188, 401/269, 270, 273–275, 278, 286; 132/112, 132/290, 313

(56) References Cited

U.S. PATENT DOCUMENTS 1,044,996 A * 11/1912 Cuthbertson ..... 401/178
6,142,695 A * 11/2000 Byun ..... 401/188 R
6,234,181 B1 * 5/2001 Lou ..... 132/313
6,418,939 B1 * 7/2002 Byun ..... 132/313
6,533,482 B1 * 3/2003 Byun ..... 401/188 R
6,688,796 B1 * 2/2004 Liu ..... 401/286
6,752,558 B1 * 6/2004 Hsu ..... 401/286
2002/0040720 A1 * 4/2002 Byun ..... 401/187

* cited by examiner

*Primary Examiner*—Khoa D. Huynh
(74) *Attorney, Agent, or Firm*—Birch, Stewart, Kolasch & Birch, LLP

(57) ABSTRACT

A cosmetics including a sleeve type protection cap for enclosing the brush during make-up, a main body and a brush member; wherein the protection cap has a movable body mounted inside the cap to generate air pressure while moving upward/downward together with movement of the protection cap and, the generated air pressure allowing powdery or liquid state cosmetics to be discharged out of the main body to the brush member so that it accomplishes the make-up.

2 Claims, 10 Drawing Sheets

COSMETICS BRUSH

This non-provisional application claims priority under 35 U.S.C. § 119(a) based on Patent Application No. 2004-0011020 filed in Korea on Feb. 19, 2004, the subject matter of which is herein incorporated by reference.

BACKGROUND OF THE INVENTION

1. Field of the Invention

The present invention relates to a cosmetics brush, more particularly, a cosmetics brush including a sleeve type protection cap for protection of the brush during make-up, a main body and a brush member; wherein the protection cap has a movable body mounted inside the cap to generate air pressure while moving upward/downward together with movement of the protection cap and, the generated air pressure allowing powdery or liquid state cosmetics to be discharged out of the main body to the brush member so that it accomplishes convenience of the make-up.

More specifically, the present invention is purposed of providing a cosmetics brush including a main body, a movable body having a moving bar with a number of vertical holes, a brush protection cap for moving the movable body upward/downward to generate the air pressure, a container for powdery and/or liquid state cosmetics, a filter built inside an inner movable body of the brush, and a brush member; wherein the liquid state and/or powdery cosmetics is filtrated through the filter by the air pressure generated, passes through the vertical holes in the moving bar and is moderately discharged to the brush member as an optimum particle form so that it accomplishes convenient use of the cosmetics brush.

2. Description of the Related Art

In general, cosmetics are divided into powdery and/or liquid states. Recently, the cosmetic goods such as lip-stick or foundation are available in the liquid state to improve convenience for users. The liquid cosmetics, for example, is charged within a specified container generally having a pencil form and discharged out of inner space of the container to an upper portion mounted by a cosmetic brush member of the container, when turning any portion of the container. Various forms and structures of such container have been proposed and used.

Conventional cosmetics brush which is generally constructed by integrating a brush member to a main body of the brush and is used by covering the brush member with alternative cosmetics when doing the make-up has an inconvenience to carry and handle it due to separable possession of the cosmetics and the brush member, to cause a difficulty in using the brush.

In recent years, different structures of cosmetic brushes which receive powdery cosmetics inside a container type body and discharge the cosmetics to a brush member by air pressure suitable to do the make-up, have been proposed and applied, for example, the cosmetics brush being disclosed in Korean Utility Model Reg. No. 253,672 having the construction as shown in FIGS. 9 and 10 attached herein below.

Such cosmetics brush includes a first body 102 in a tube form having opened at top and bottom ends to receive powdery cosmetics 103 inside; a second body 106 coupled to lower peripheral side of the first body 102, having an exhaust nozzle 107 on middle portion of top side and a brush member 108 connected to the exhaust nozzle 107; an upward/downward delivery shaft 109 having connected to a spring 110 at peripheral side of front end thereof leading the front end to coupled with the exhaust nozzle 107 of the second body 106 and the spring 110 to be mounted on and supported by peripheral side of top end of the exhaust nozzle 107; and an top side cap 113 for protruding top end of the upward/downward delivery shaft 109 outside of upper portion of the brush and for supporting the top end.

By the above construction, the user pushes a button as the first body 102 joined at top end of the upward/downward delivery shaft 109 and protruded upward when employing the cosmetics brush 100 to do the make-up. At this time, the spring 110 provided to front end of such upward/downward delivery shaft 109 moves the shaft 109 in upper or lower directions so that movement of the shaft 109 makes the powdery cosmetics 103 received inside the first body 102 to flow out to external side, that is, to the brush member 108 through the exhaust nozzle 107 formed in the second body 106, therefore, to achieve a convenient use of the cosmetic brush.

Herein, the powdery cosmetics 103 discharged through such exhaust nozzle 107 is supplied to the brush member 108 by directly passing the front end of the upward/downward delivery shaft 109 through the exhaust nozzle 107.

However, several problems exist in the conventional cosmetics brush as described above, for example, that since the powdery cosmetics 103 flows out to the brush member 108 by means of the front end of such upward/downward delivery shaft 109, the brush has not only a difficulty in constantly and continuously exhausting the powdery cosmetics 103 due to constructional restriction of the delivery shaft 109, but also a discomfort to use because the powdery cosmetics 103 is discharging to the brush member 108 by joggle of the cosmetics brush itself.

Further, another button 112 formed at the top side cap 113 which has a specified structure of being always protruded outside by elastic force of the spring 110, has a disadvantage that the button 112 moves and causes undesirable exhaust of the powdery cosmetics 103 to the brush member 18 if the cosmetics brush is bumped against other items under carrying and holding conditions or is under external force. In addition, when the cosmetics brush is stored and/or held in high humidity conditions, or is not employed for long term, the powdery cosmetics 103 contained in the first body 102 and the one remained in the exhaust nozzle 103 are hardened owing to moisture. Thus, the known cosmetics brush in prior art cannot smoothly exhaust the powdery cosmetics 103.

SUMMARY OF THE INVENTION

It is, therefore, an object of the present invention is to solve the above problems, in particular, to provide a cosmetics brush including a sleeve type protection cap mounted around peripheral side of a brush member for protection of the cosmetics brush and a main body; wherein liquid status or powdery cosmetics stored inside the main body is discharged to the brush member simultaneously with filtration of the cosmetics through a filter to ensure an optimum condition of preferably exhausting the cosmetics in a desirable amount.

BRIEF DESCRIPTION OF THE DRAWINGS

The above object, features and advantages of the present invention will become more apparent to those skilled in the related art from the following detailed description for preferred embodiments taken in conjunction with the accompanying drawing, in which.

DETAILED DESCRIPTION OF THE PREFERRED EMBODIMENT

The present invention will be described in more detail be reference to the accompanying drawings and following embodiments which are presented for purpose of illustration and should not be construed to limit the scope of the invention thereto.

Figure 1:
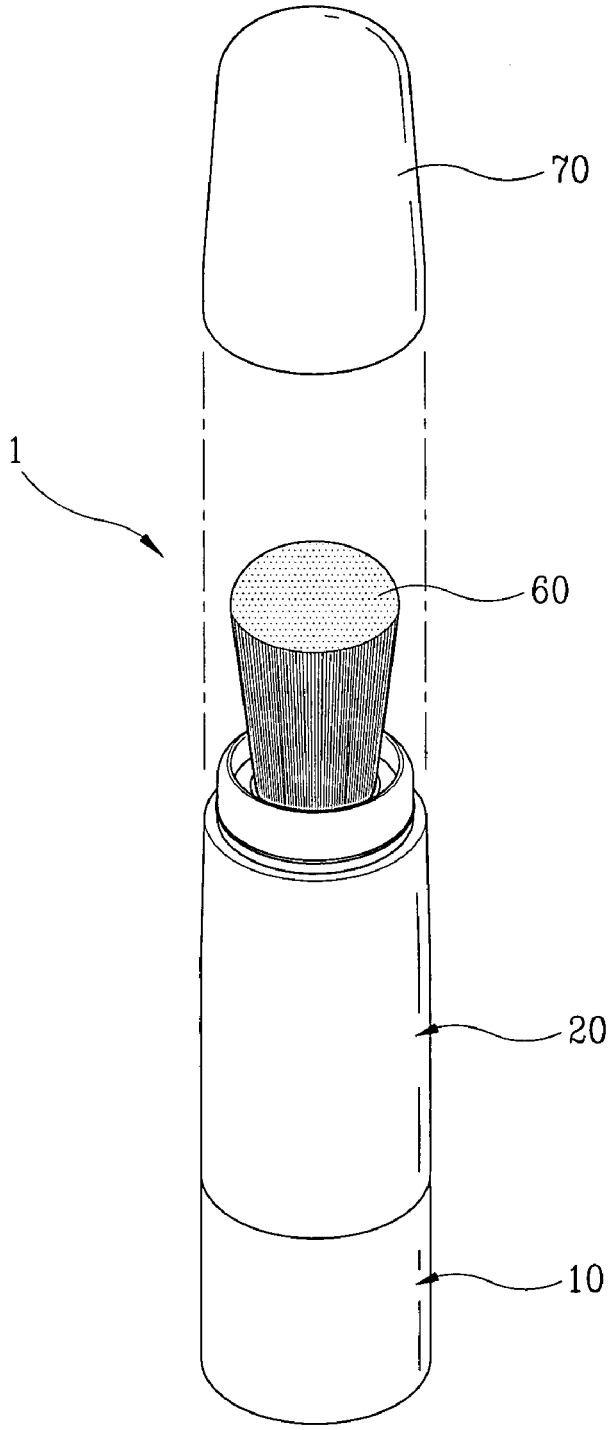
FIG. 1 is a perspective view illustrating an example of a cosmetics brush according to the present invention.
Figure 2:
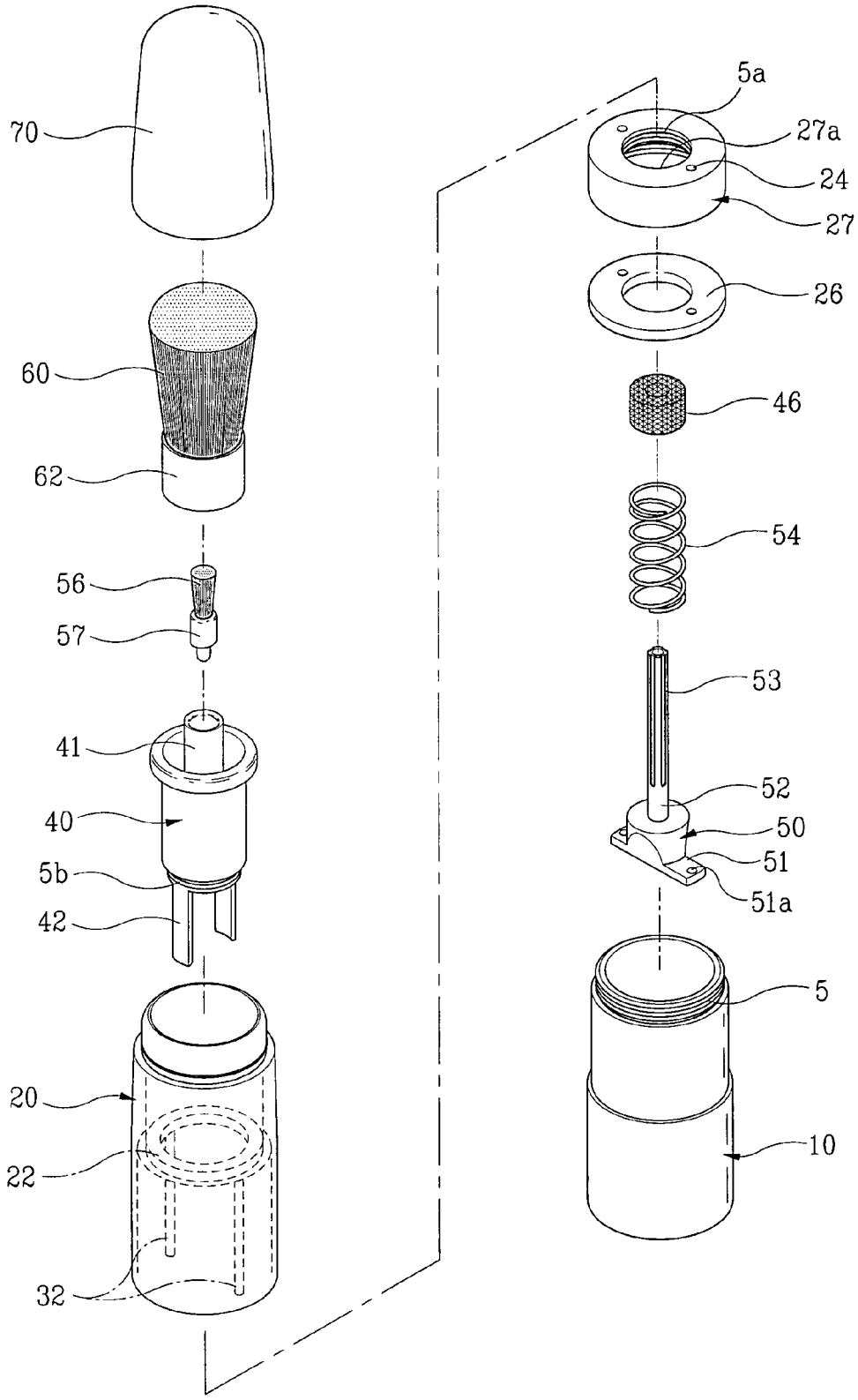
FIG. 2 is an exploded perspective view illustrating the example of the cosmetics brush according to the present invention.
Figure 3:
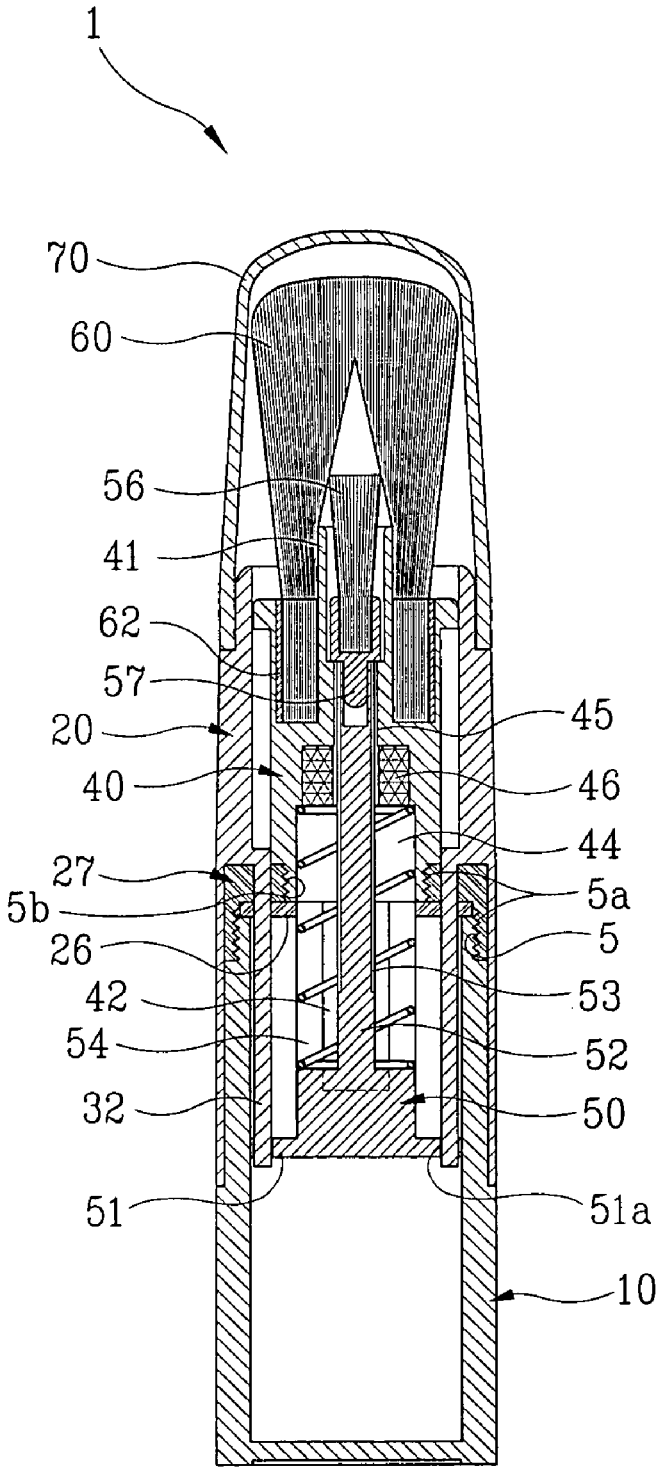
FIG. 3 is a cross-sectional view illustrating the cosmetics brush according to the present invention in a state that the sleeve type protection cap is directed downward during holding and carrying the brush.
Figure 4:
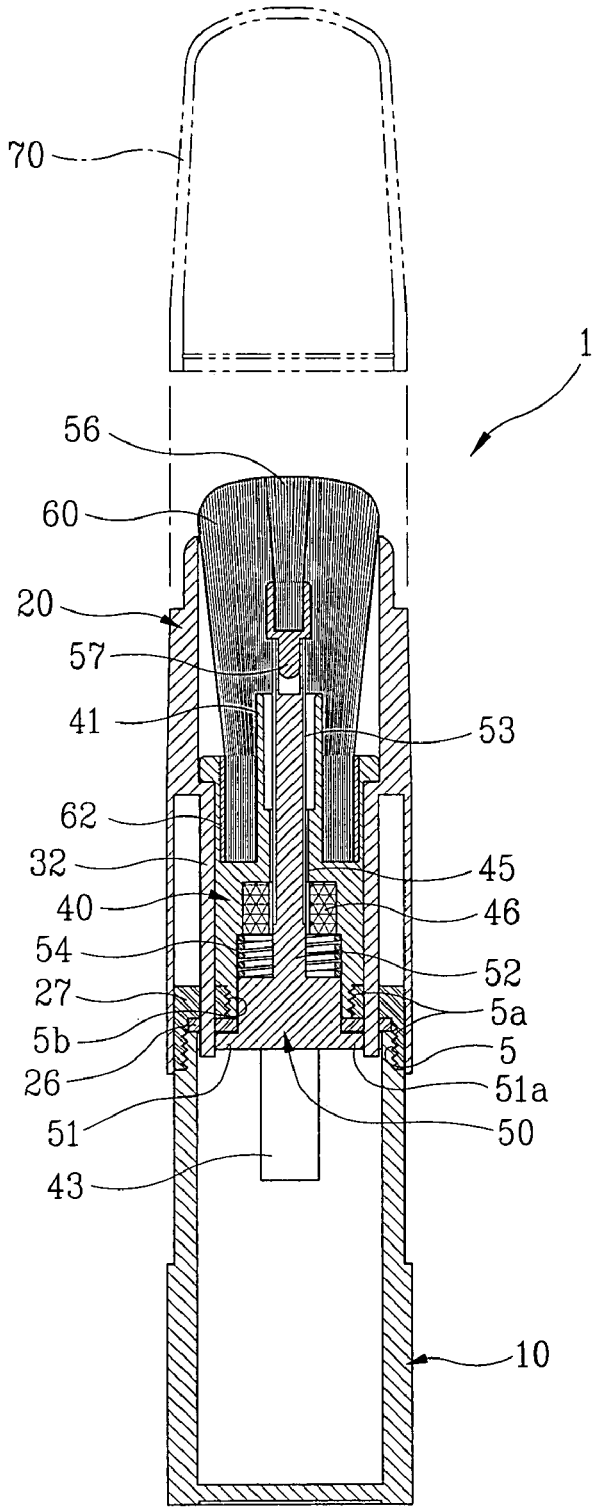
FIG. 4 is a cross-sectional view illustrating the cosmetics brush according to the present invention in a state that the sleeve type protection cap is pulled outside.
Figure 5:
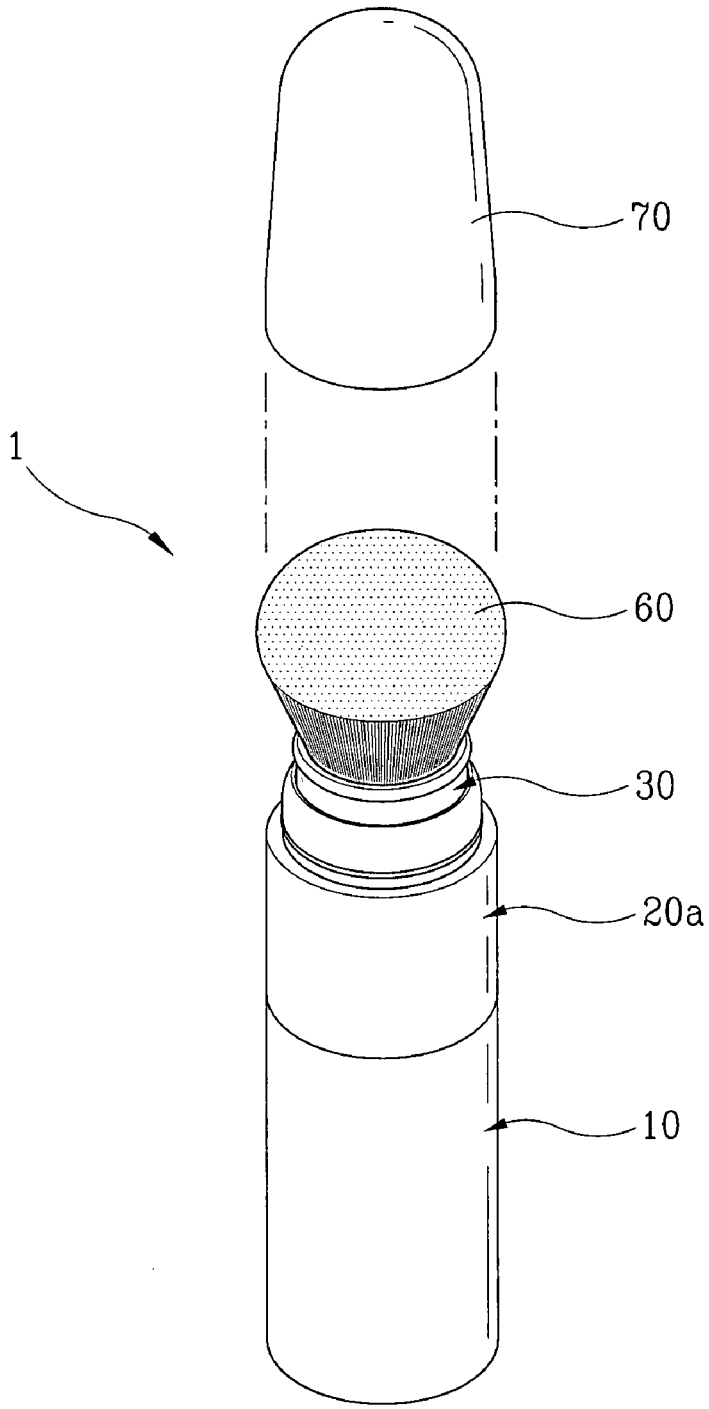
FIG. 5 is a perspective view illustrating alternative example of the cosmetics brush according to the present invention.

FIG. 1 illustrates a perspective view of an example of the cosmetics brush according to the present invention. FIG. 2 illustrates an exploded perspective view of the example of the cosmetics brush according to the present invention. FIG. 3 shows a cross-sectional view illustrating the cosmetics brush according to the present invention in a state that the sleep type protection cap is directed downward during holding and carrying the brush. FIG. 4 shows a cross-sectional view illustrating the cosmetics brush according to the present invention in a state that the sleeve type protection cap is pulled outside.

The cosmetics brush 1 of the present invention includes a main body 10 to receive powdery and/or liquid state cosmetics (hereinafter, referring to as 'powder'); and a sleeve type protection cap 20 coupled on top portion of the body 10 for enclosing a brush member 60 to protect it.

The protection cap 20 is integrated with an inner supporting wheel 22 having cylindrical supporting bars 32 elongated to both bottom sides of the wheel.

The inner supporting wheel of such constructed protection cap 20 is connected with a fixture cap 27 and an O-ring 26 fitted on the supporting bar 32.

The fixture cap 27 has a cross-section in a form of bottle cap having a punctured hole 27*a* on center portion thereof; a screw portion 5*a* being formed over both inner sides of the fixture cap 27 and the punctured hole 27*a*.

An inner movable body 40 having bridge shape of guidance pieces 42 is fitted inside upper portion of the protection cap 20. Another screw portion 5*b* formed on lower portion of the protection cap 20 is screw-coupled with the screw portion 5*a* formed inside the punctured hole 27*a* in the fixture cap 27.

The protection cap 20, the inner movable body 40 and the fixture cap 27 are together integrated into an assembly, which is also arranged with a filter 46, an O-ring 26, a spring 54 and a movable body 50. The filter 46 is fitted into the inner movable body 40 while the O-ring 26 being fitted into the bottom portion of the fixture cap 27. The movable body 50 has a moving bar 52 with the spring 54 around and passing through a powder exhaust duct 41 of the inner movable body 40. On top end of the moving bar 52 punctured through the duct 41, a push-cap 57 having an assisting brush 56 is fixed and connected.

Such movable body 50 is positioned within the guidance piece 42 protruded on bottom portion of the inner movable body 40, so that when the movable body 50 moves upward/downward, it can conduct perpendicular motion along the guidance piece 42. Around the moving bar 52, several vertical holes 53 are punctured in top and bottom directions to pass the powder.

Moreover, bottom end of the supporting bar 32 is inserted and fixed into a fitting hole 51*a* of the movable body 50 to form a gap spaced between the movable body 50 and the sleeve type protection cap 20 by a constant interval. Such O-ring 26 and a guidance hole 24 of the fixture cap 27 are entered into the supporting bar 32. The spring 54 is placed and extended between the inner movable body 40 and the movable body 50 as a typically initial condition of the cosmetics brush.

A brush member 60 bundled by a clip 62 is fixed around the powder exhaust duct 41.

An assembly formed by the brush 60 fixed around the powder exhaust duct 41 is connected at lower portion thereof with the main body 10 charged with the powder by means of screw-connection manner while covering top portion of the brush member 60 with a cover 70, thereby resulting in the final cosmetics brush assembly 1 as an example of the present invention.

Such main body 10 has a screw member 5 coupled with the screw portion 5*a* of the fixture cap 27.

Based on the above structure of the cosmetics brush according to the present invention, the functional effect of the cosmetics brush will be described in more detail as follows.

As shown in FIG. 3, the cosmetics brush 1 according to the present invention receives the powder, has the protection cap 27 and the movable body 50 going down by elastic force of the spring 54 to close the exhaust nozzle 45 formed on the lower portion of the power exhaust duct 41 when it is normally held and/or carried. In order to do the make-up with the above state of the cosmetics brush, the user should grip the main body 10 by one hand, while pulling out the protection cap 20 outside to the movable body 50 integrated with the protection cap 20 by means of the supporting bar 32 slides upward along the guidance piece 42 formed on lower portion of the inner movable body 40, and applies a pressure to inside of the inner movable body 40. As a result, the powder in the main body 10 flows to and passes the vertical holes 53 formed around peripheral side of the movable bar 52, the exhaust nozzle 45 and the powder exhaust duct 41 in order, as shown in FIG. 4. The passed powder flows to and is exhausting to the assistant brush 56 and the brush 60 in a constant amount suitable to do the make-up.

Furthermore, the powder discharged out of the powder exhaust duct 41 passes through a filter 46 formed in the lower portion of the inner movable body 40 to remove impurities or agglomerates before the exhausting process, so that fine powders only can flow into the powder exhaust duct 41.

Then, by releasing the pulling force applied to the sleeve type protection cap 20, the protection cap 20 and the movable body 50 go down together and return to original positions thereof by elastic force of the spring 54 located between the inner movable body 40 and the movable body 50.

As described above, repetition of pulling and releasing the protection cap 20 induces the powdery cosmetics charged inside the main body 10 to be exhausted to the assisting brush 56 and the brush member 60 and allows the user to put into the make-up.

Although figures attached herewith show the brush member 60 as faced upward for convenience for illustration of the present invention, it is possible to easily exhaust the powdery cosmetics by directing the brush member 60 downward and pulling the protection cap 20, when the cosmetics brush is used.

Referring to FIGS. 5 to 8, illustrated is another example of alternative cosmetics brush according to the present invention.

As shown in FIGS. 5 to 8, the cosmetics brush 1 includes a main body 10 to receive the powdery cosmetics and a screw member 5 to connect the main body 10 with another screw portion 5*c* inside an outer movable body 20*a*.

An inner supporting wheel 22 with a diameter less than that of the outer movable body 20*a* and having alternative screw portion 5*c* is formed at top portion of the screw member 5 within the outer movable body 20. Guidance holes 24 are formed on both sides of any desirable position around the inner supporting wheel 22.

The outer movable body 20*a* with such construction as described above, is fitted with a sleeve type protection cap 30 for protection of the cosmetics brush mounted with a supporting bar 32 on top portion thereof such that the supporting bar 32 can slide inside the guidance hole 24.

Additionally, inside the sleeve type protection cap 30, provided are bridge type guidance pieces 42 at both sides of a lower desirable position thereof, and an inner movable body 40 having a powder exhaust duct 41 fitted into an inner top portion and screw-connected to the screw portion 5*c* formed on the inner supporting wheel 22 of the outer movable body 20*a* by another screw portion 5*b* at the lower portion of the inner movable body 40.

The guidance piece 42 is held in a protruded position from bottom portion of the outer movable body 20*a*.

Such protection cap 30, the inner movable body 40 and the outer movable body 20*a* are integrated into an assembly by means of an O-ring 26, a filter 46, a spring 54 and a movable body 50. The O-ring 26 is fitted into bottom portion of the inner supporting wheel 22 of the outer movable body 20*a* while the filter 46 being coupled into the inner movable body 40. The movable body 50 fitted with the spring 54 has a moving bar 52 passing through the powder exhaust duct 41 of the inner movable body 40 and assembled with a push-cap 57 having an assisting brush 56 at top end of the moving bar 52.

Since the movable body 50 is placed inside the guidance piece 42 protruded from the bottom portion of the outer movable body 20*a*, it can move upward/downward to conduct displacement along the guidance piece 42. Around the moving bar 52, several vertical holes 53 are formed in top/bottom directions to serve as a passage for the powder.

Two supporting bars 32 are mounted and spaced at a constant interval on both sides between the movable body 50 and the protection cap 30. The O-ring 26 and the guidance hole 24 are fitted into the supporting bars 32 while the spring 54 being mounted between the outer movable body 20*a* and the movable body 50.

A brush member 60 in a bundle form by a clip 62 is fitted around the powder exhaust duct 41 and covered by a cover 70 on top side thereof.

Figure 6:
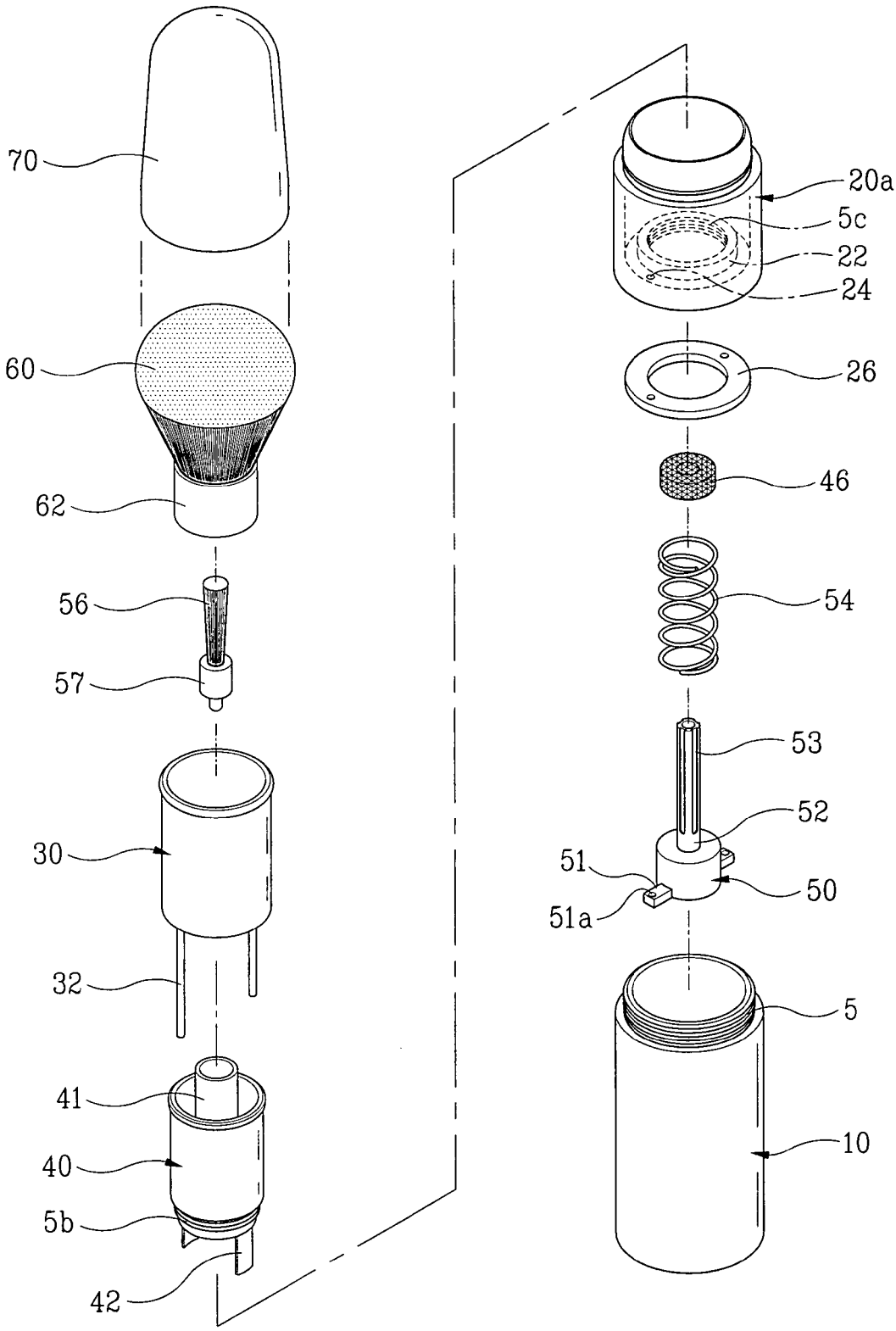
FIG. 6 is an exploded perspective view illustrating the alternative example of the cosmetics brush according to the present invention.

Based on the above structure of the alternative cosmetics brush according to the present invention with reference to accompanying FIGS. 6 to 8, the functional effect of the cosmetics brush will be described in more detail as follows.

Figure 7:
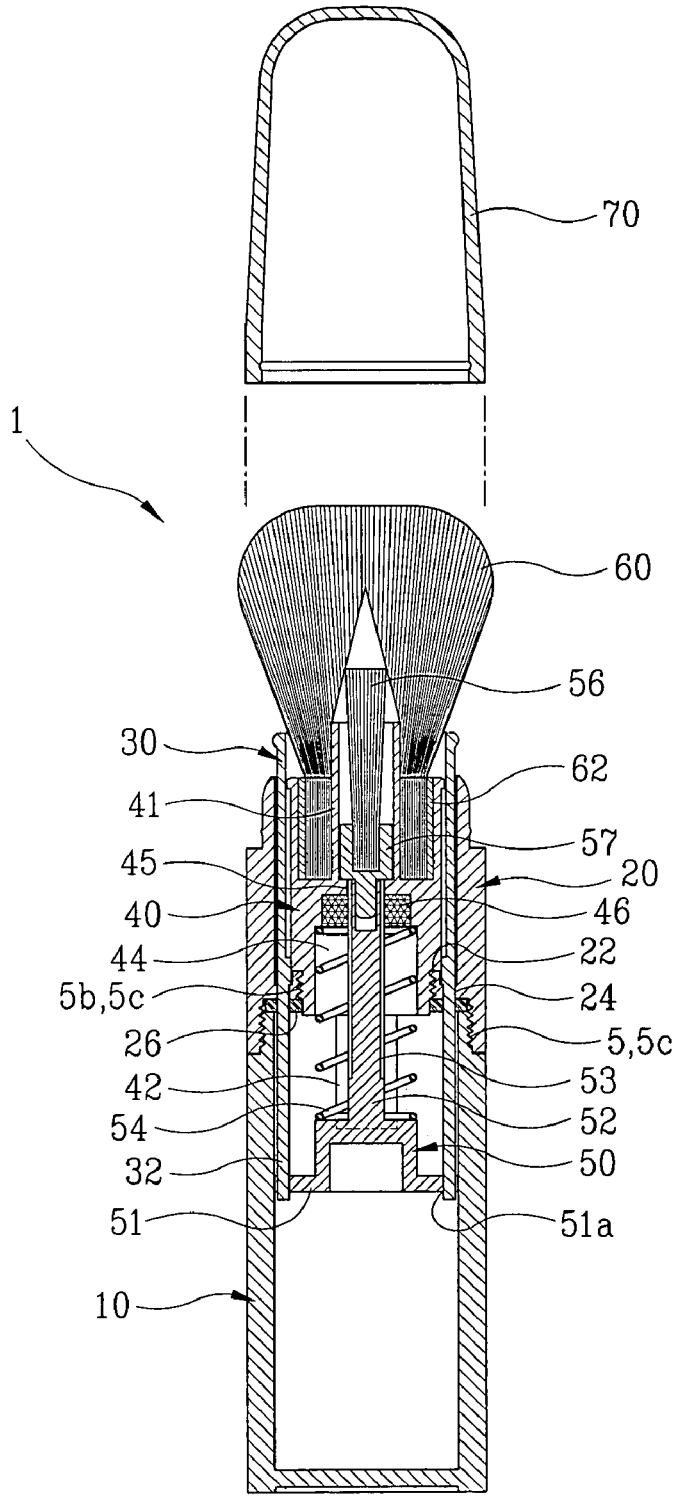
FIG. 7 is a cross-sectional view illustrating the alternative cosmetics brush according to the present invention in a state that the sleeve type protection cap is directed downward during holding and carrying the brush.
Figure 8:
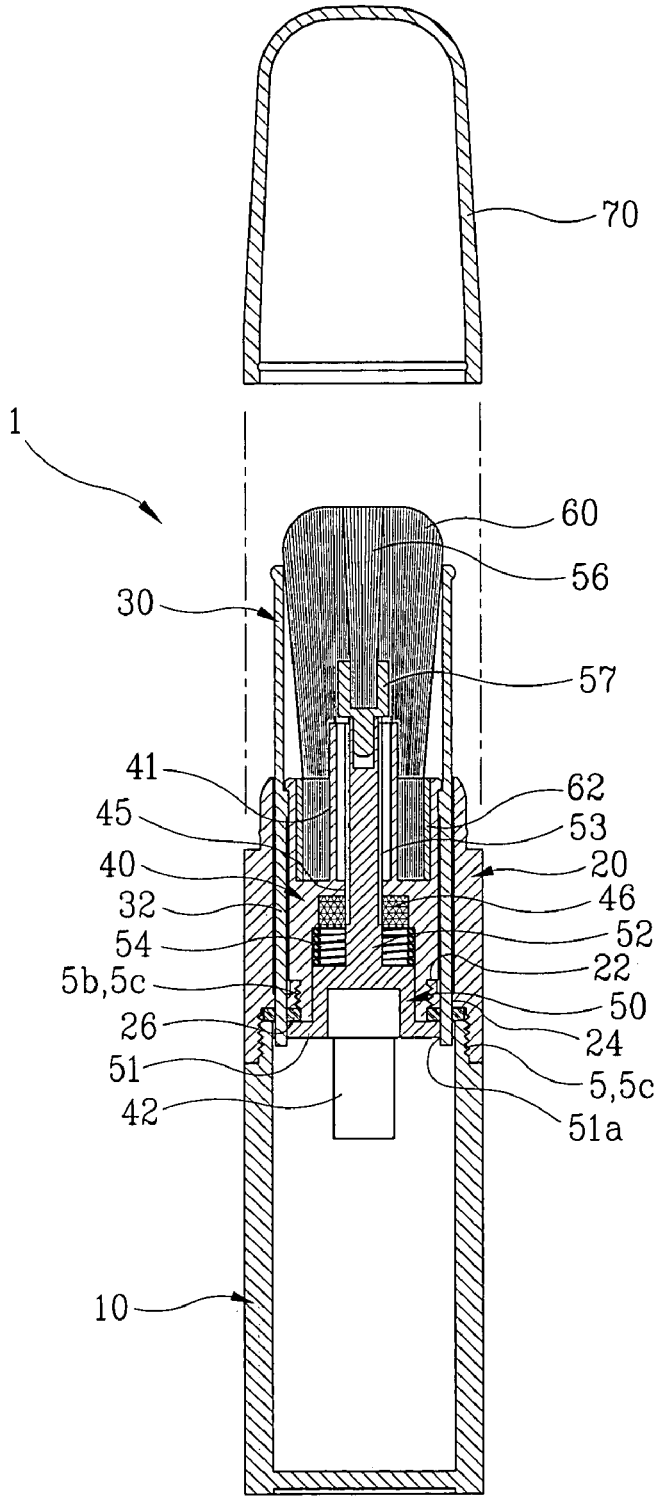
FIG. 8 is a cross-sectional view illustrating the alternative cosmetics brush according to the present invention in a state that the sleeve type protection cap is pulled outside.
Figure 9:
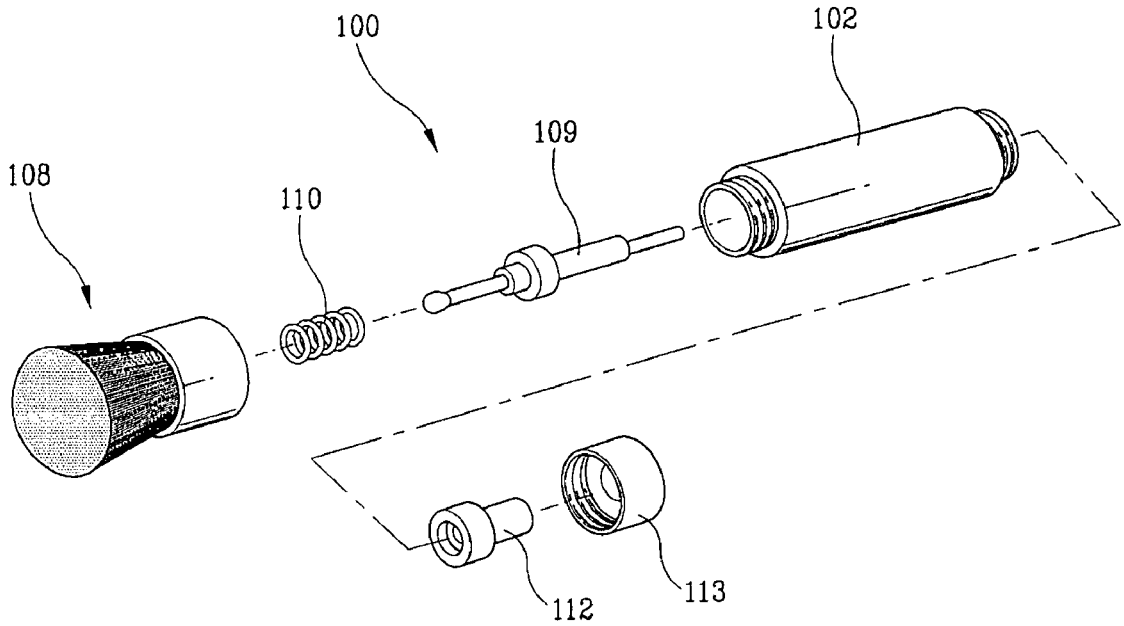
FIG. 9 is a perspective view of a conventional cosmetics brush.
Figure 10:
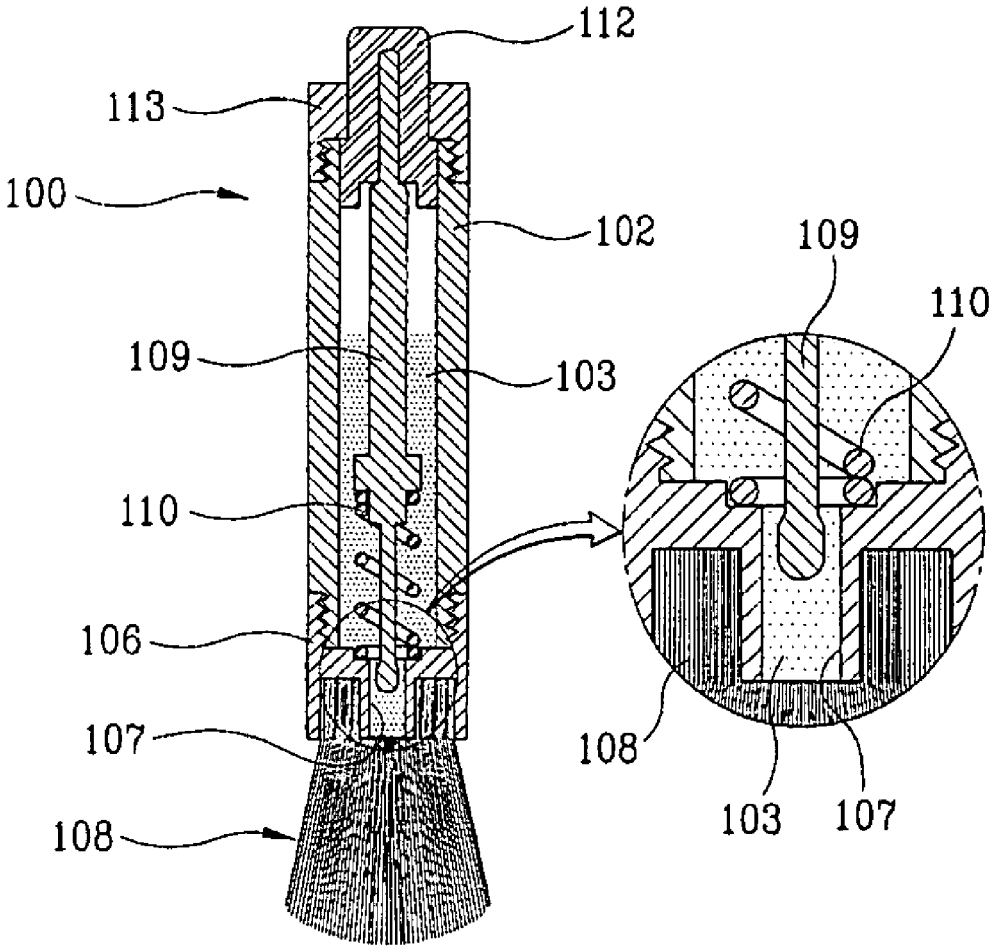
FIG. 10 is an exploded perspective view of the conventional cosmetics brush.

As shown in FIG. 7, the cosmetics brush according to the present invention receives the powder in the main body 10 when it is normally held and/or carried, has the sleeve type protection cap 30 inside the outer movable body 20*a*, the moving bar 52 fitted on the powder exhaust nozzle 45 formed in the inner movable body 40 at top end thereof, the push-cap 57 fixed on top end of the nozzle 45 to close the nozzle 45, and the movable body 50 formed in a state capable of sliding into the guidance piece 42.

In order to do the make-up as the powdery cosmetics is charged in the cosmetics brush and the powder exhaust nozzle 45 is closed, the user should grip the main body 10 by one hand and, by the other hand, pull top peripheral side of the sleeve type protection cap 30 fitted between the inner and the outer movable bodies 40 and 20*a*, so that the movable body 50 coupled to the supporting bar 32 at the lower portion of the protection cap 30 goes upward along the guidance piece 42 and the powdery cosmetics charged in the main body 10 flows out through the vertical hole 53, the powder exhaust nozzle 45 and the powder exhaust duct 41 in order, and is exhausting to the assisting brush 56 and the brush member 60 in a constant amount by applying an air pressure inside the inner movable body 40, thereby resulting in doing the make-up.

The powder exhausted into the powder exhaust duct 41 passes through the filter 46 mounted on the lower portion of the inner movable body 40 to remove agglomerates and impurities before the exhausting process, so that fine powder only flows into the powder exhaust duct 41.

Next, by releasing the pulling force applied to the sleeve type protection cap 30, the protection cap 30 and the movable body 50 go down together and return to original positions thereof by elastic force of the spring 54 located between the inner movable body 40 and the movable body 50.

As described above, repetition of pulling and releasing the protection cap 30 induces the powdery cosmetics charged inside the main body 10 to discharge to the assisting brush 56 and the brush member 60 and allows the user to put into the make-up.

As described above, the cosmetic brush of the present invention includes a sleeve type protection cap placed around peripheral side of a brush member for protection of the cosmetics brush; wherein the protection cap has a movable body mounted inside the cap by a supporting bar and moving upward/downward to generate air pressure, the generated air pressure allowing powdery or liquid state cosmetics to be discharged out of the main body to the brush member so that it accomplishes a convenience for the make-up.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cosmetics brush including:

a sleeve type protection cap 20 having an inner supporting wheel 22 having elongated supporting bars elongated to both bottom sides of said wheel and disposed 32 inside the protection cap;

a fixture cap 27 including a main body 10 containing powdery cosmetics on lower portion thereof and coupled into bottom portion of the inner supporting wheel 22 of the protection cap 20, and an inner movable body 40 having a powder exhaust duct on an upper portion 41 and guidance pieces 42 on a lower portion thereof, such that all of these parts are integrated into an assembly and move together;

a movable body 50 moving together with movement of the protection cap 20 to generate air pressure by integrating the movable body 50 with the protection cap at a constant interval by means of the supporting bars 32, so that the powdery cosmetics charged in the main body 10 is supplied to both of the brushes 56 and 60; and a spring 54 mounted between the inner movable body 40 and the movable body 50 and for preventing flowing out of the powdery cosmetics by pushing the movable body 50 integrated with the protection cap 20 downward at a closed condition.

2. The cosmetics brush according to claim 1, wherein it further includes a moving bar 52 having vertical holes 53 for delivering powdery cosmetic on top portion of the movable body 50 extended and fitted into the powder exhaust duct 41, and a push-cap 57 having the assisting brush 56 fitted at top end of the moving bar 52.

* * * * *